United States Patent [19]

Bishop, Jr. et al.

[11] Patent Number: 4,853,678

[45] Date of Patent: Aug. 1, 1989

[54] ADVERTISING DEVICE

[76] Inventors: Chester O. Bishop, Jr., 218 Don Buck Rd., Massey; Malcolm I. Dennis, 20 Cadman Ave., One Tree Hill; Peter S. Riley, 41 Finch St., Mt. Albert; Christopher C. Richardson, 14 St. Leonards Rd., Kelston; Vincent P. Shaw, 6 Metcalfe Rd., Ranui, all of Auckland, New Zealand

[21] Appl. No.: 149,076

[22] Filed: Feb. 1, 1988

[30] Foreign Application Priority Data

Feb. 5, 1987 [NZ] New Zealand ..... 219198

[51] Int. Cl.[4] ..... G08B 23/00

[52] U.S. Cl. ..... 340/573; 340/326

[58] Field of Search ..... 340/573, 567, 693, 326, 340/815.16, 815.21, 815.27; 364/516; 250/342, 221; 362/802; 40/463, 902, 465; 84/464 R; 312/253; 248/551; 109/51

[56] References Cited

U.S. PATENT DOCUMENTS

| | | | |
|---|---|---|---|
| 3,594,760 | 7/1971 | Haker | 340/326 X |
| 3,916,401 | 10/1975 | Freeman | 340/326 X |
| 4,222,188 | 9/1980 | Tarrant et al. | 40/152.1 |
| 4,249,684 | 2/1981 | Miller et al. | 109/51 X |
| 4,346,427 | 8/1982 | Blissett et al. | 340/573 X |
| 4,358,754 | 11/1982 | Young et al. | 340/815.17 |
| 4,391,204 | 7/1983 | Mitchell et al. | 109/51 X |
| 4,709,330 | 11/1987 | Yokoi et al. | 340/573 X |
| 4,722,285 | 2/1988 | Goodman | 248/551 X |

FOREIGN PATENT DOCUMENTS

| | | | |
|---|---|---|---|
| 3334554 | 4/1985 | Fed. Rep. of Germany | 362/802 |

*Primary Examiner*—Glen R. Swann, III
*Assistant Examiner*—Thomas J. Mullen, Jr.
*Attorney, Agent, or Firm*—Young & Thompson

[57] ABSTRACT

An advertising device for use in retail outlets, including a passive infra-red sensing system, a sign bearing a message, and signalling means by which the attention of persons in the vicinity can be attracted, wherein the presence of persons in the vicinity may be detected by the sensing means and said signalling means may be activated to attract attention to the sign.

3 Claims, 2 Drawing Sheets

ADVERTISING DEVICE

FIELD OF THE INVENTION

Figure 1:
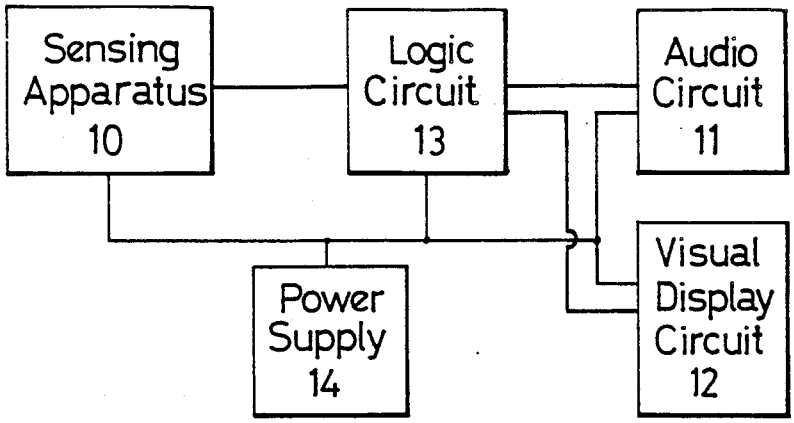

This invention relates to advertising apparatus, and more particularly to such apparatus in combination with sensing apparatus.

1. BRIEF DESCRIPTION OF THE PRIOR ART

Advertising display devices have hitherto been known having illuminated or other displays which are activated upon detection of a person by detection apparatus. Examples of these can be found in U.S. Pat. No. 3,594,760, F. H. Haker (1971), U.S. Pat. No. 3,916,401, H. E. Freeman (1975), and U.S. Pat. No. 4,222,188, Tarrant et al. (1980). A variety of pressure sensing systems have been used in such devices to detect the presence of a person at a location suitable for viewing the display.

Alarm apparatus has also been known for the detection and disclosure of persons or animals within an area, using active or passive infrared detectors. Examples of these can be seen in U.S. Pat. No. 4,375,034, J. K. Cruscott (1983) and U.S. Pat. No. 3,924,130, Cohen et al. (1975).

U.S. Pat. No. 4,346,427, Blissett et al. (1982) describes apparatus for controlling lighting, temperature and the like in a building, responsive to the presence of persons in an area, using infra-red detection apparatus.

2. OBJECT OF THE INVENTION

It is an object of the present invention to go at least partway towards providing advertising apparatus sensitive to the presence of a potential audience, and preferably suitable for use in retail outlets, or at least to provide the advertising and/or retail industry with a useful choice.

SUMMARY OF THE INVENTION

In one aspect the invention provides advertising apparatus including passive infra-red detection means, by which in normal use the presence of one or more persons in an area can be detected, display means directed at the area, and control means responsive to operation of the infra-red detection means for activating and controlling the display means.

Preferably the broadcast and/or display means includes passive and active elements, wherein active elements are activated upon detection of a person by the sensing means.

Preferably the broadcast and/or display means includes visual and audio elements.

In another aspect the invention provides advertising apparatus particularly adapted for use in supermarkets, including a cabinet, and broadcast and/or display means integral with or contained in the cabinet.

Preferably the broadcast and/or display means is at least in part power-operated, and the power source is contained in the cabinet.

Preferably the broadcast and/or display means is at least in part sensor-activated, and the sensor means is contained in the cabinet.

Preferably there is provided means to fix the cabinet to a shelf.

In another aspect the invention provides a cabinet for an advertising device, including means by which the cabinet may be fixed to a shelf, wherein the fixing means can in normal use only be accessed from inside the cabinet.

Preferably the fixing means includes a bracket element fixed to the shelf and also fixed to the cabinet, wherein access to means by which the bracket element is fixed to the shelf is prevented by the body of the cabinet, and access to means by which the bracket element is fixed to the cabinet is in normal use only possible from inside the cabinet.

In a further aspect the invention provides a method for broadcasting and/or display including sensing the presence of a person in an area, and activating apparatus to produce a broadcast and/or display, wherein the presence of a person in the area is sensed with a passive infra-red sensor.

PREFERRED EMBODIMENT

The following is a description of preferred forms of the invention, given by way of example only, with reference to the accompanying drawings, in which:

FIG. 1: illustrates diagramatically the circuitry of the preferred apparatus.

Figure 2:
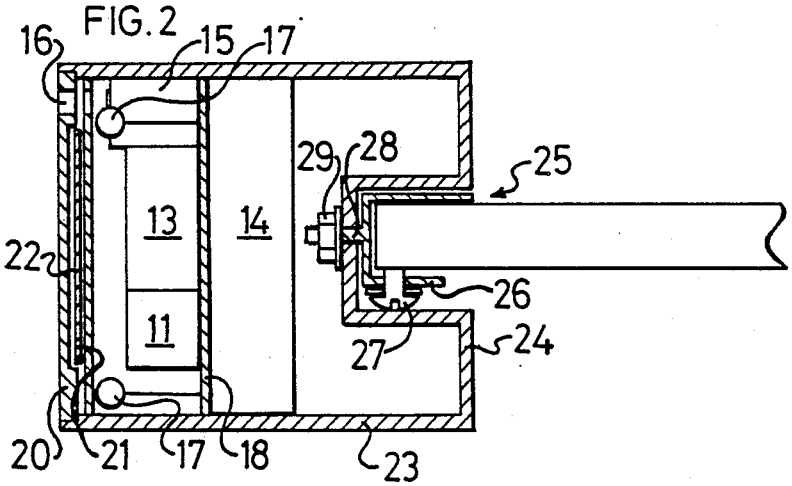

FIG. 2: illustrates preferred apparatus in side view and in section.

Figure 3:
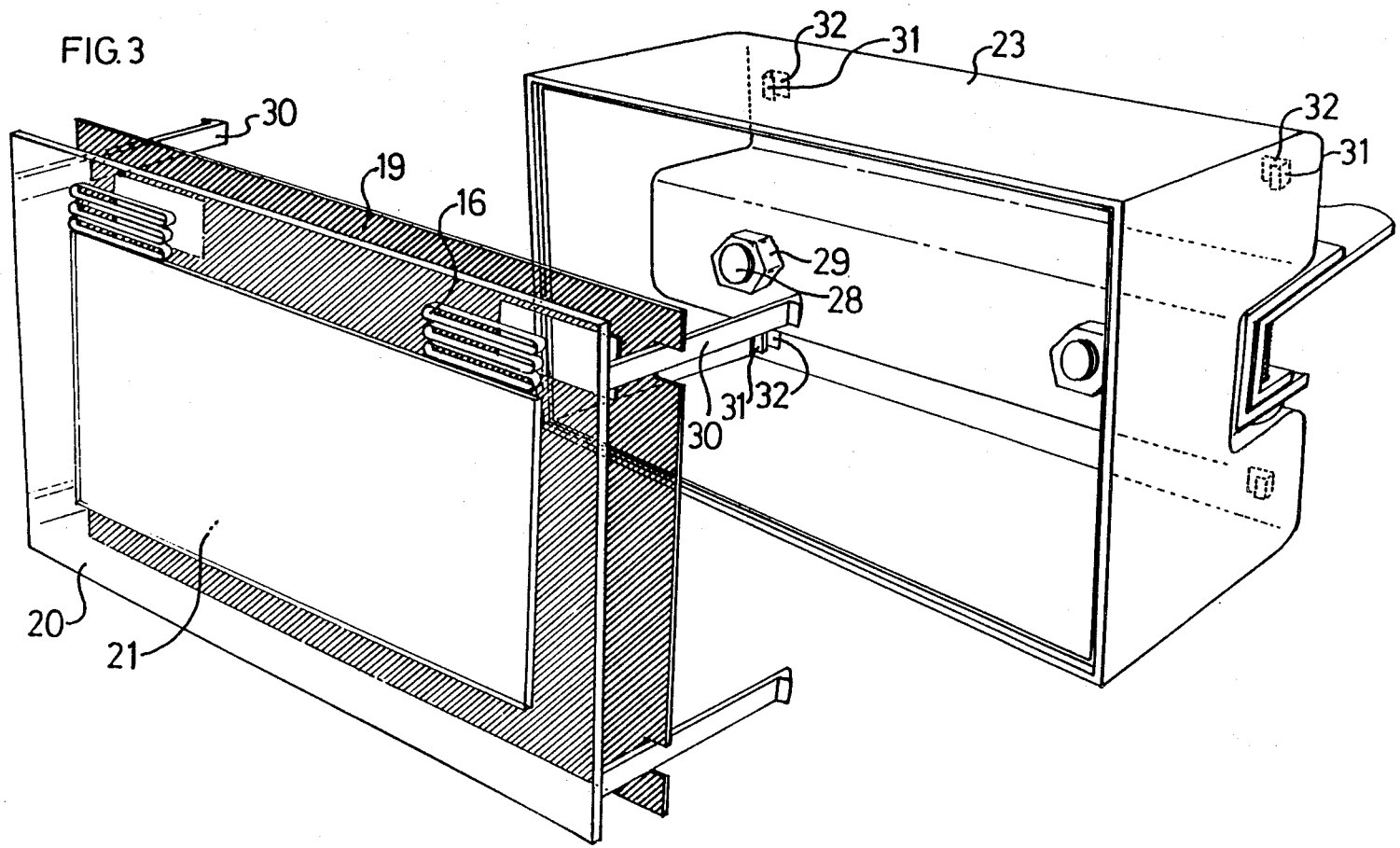

FIG. 3: illustrates parts of the preferred apparatus in an exploded perspective view.

As illustrated in the diagram of FIG. 1, the invention in its preferred form includes sensing apparatus 10 linked to an audio circuit 11 and a visual display circuit 12 by a logic circuit 13, preferably programmable. The apparatus is preferably powered by internal supply means 14, although it could feasibly be powered from an external power supply.

The preferred apparatus is intended for use in supermarkets or similar retail outlets. It is adapted for attachment to a shelf holding products for sale, and is intended to sense the presence of passing shoppers and attract their attention to a particular product on the shelf. The sensing apparatus 10 will in normal use detect the presence of one or more persons near the shelf with which it is associated, and through the logic circuit 13 activate the audio circuit 11 and/or the visual display circuit 12. As shown in FIG. 2, the sensing apparatus 10 uses one or more passive infra-red sensors 15 which detect changes in temperature within an area. When placed on a supermarket shelf and directed across an aisle, such a sensor would most practically be tuned to detect changes in temperature within a 5° to 30° arc for a distance of 2 to 3 meters, but this field could be altered to suit a particular location. If two or more such sensors are used it may be desirable to tune them such that each senses temperature change within a narrow arc, possibly 5° or less, and to direct them at different areas. A person moving past the apparatus may then be detected by each sensor in turn at intervals, and may activate the audio circuit 11 and/or the visual display circuit 12 several times while passing. Each sensor might be arranged to cause a different audio or visual signal, such that the display changes as a person passes the apparatus.

It is preferred that the infra-red sensors 15 detect change in temperature by an amount related to human body temperature, rather than simply measuring the temperature and activating the apparatus when a particular threshold is crossed. By this means the apparatus will only be activated by a person entering the detecting field of the sensor, and will not be continuously activated by a person remaining in the field. Additionally, it will be activated by people entering the field even if one or more people are already there.

Temperature sensors appear preferred for use in the present application, although other types of sensors might be used.

Light beam detecting systems have commonly been used to detect the presence of people in doorways and the like, comprising a light source on one side of an area, directed at a light detector on the opposite side of the area. A person passing through the area may block the light between the source and the detector, thereby activating apparatus. Such a system suffers from a number of disadvantages however, in comparison to a passive infra-red detection system. A light beam may be interrupted (and apparatus thereby activated) by a number of things other than people, such as shopping trundlers or produce, and may be continuously activated by such an object left in the light beam. Such occurrences might well be common in a supermarket or similar situation, and the apparatus might come to be seen as undesirable by customers and/or staff as a consequence.

A futher disadvantage with such sensing apparatus is the need for both a light emitter and a light detector requiring additional space and needing careful alignment of the two parts. The possibility of one or both parts being knocked out of alignment is relatively high in a supermarket aisle, and could have undesirable consequences.

Active infra-red detector systems tend to suffer from similar disadvantages. Pressure sensors, possibly in the form of mats or lines across the floor of the aisle, could be used, but are prone to being activated by articles such as trundlers or produce accidentally left on them, and provide something of an obstacle to smooth passage along an aisle.

A passive infra-red detection system is found preferable to any of the above systems, particularly in a store, supermarket or similar application. The detection system can comprise a single unit, rather than a separate signal generator and signal receiver, and does not need to be carefully aligned, but rather can be generally directed at a suitable area.

A passive infra-red detector can be set to distinguish heat sources in an area having a temperature within a narrow, specific range, corresponding for example with the temperature range of human bodies. In this way, apparatus can be provided which is activated substantially only by the presence of a person, and not by other objects such as shopping trundlers.

Additionally the apparatus can be arranged to activate upon detection of a change in temperature corresponding to the temperature of a person. When a person enters the area in question, the apparatus will be activated, but if that person remains in the area, it will not continuously be reactivated, because the temperature in the area will not change. If that person leaves the area, or another person enters the area, a change in temperature corresponding to human body temperature will be detected, and the apparatus activated. In this way, continuous repetition of a display to the same person can be avoided, or at least limited, such that it is less likely to be found annoying or aggravating to potential customers.

The sensing apparatus 10 is set within the casing of the article, and the sensors 15 directed through apertures 16 in the front of the casing.

The audio circuit 11 may take a variety of common forms within the scope of the present invention. It may compriese relatively simple apparatus adapted to produce a single note or sound, or a series of notes forming a melody, for a set period. The volume to which the sound is amplified, and the length of time for which it sounds may be suited to the particular situation in which the apparatus is to be used, and could be adjustable. If two or more sensors 15 are to be used, the audio circuit 11 may be adapted to produce different notes or sounds depending on which sensor has been activated, and how the logic circuit 13 in turn activates the audio circuit 12.

More complex equipment might be used such that the apparatus may imitate or reproduce a human voice or other complicated sound. Similarly, different sensors 15 might in this case cause the audio circuit 11 to produce different passages of speech or sound.

The visual display apparatus preferably includes an active display, comprising the visual display circuit 12, and a passive display.

The preferred visual display circuit 12 includes a number of lights 17, such as Light Emitting Diodes, possibly arranged to form patterns, letters or words, and might also include number of other lights of various types. If the article is intended to be powered by batteries however, the number and variety of lights which can feasibly be included in the apparatus may be fairly strictly limited by the amount of power available. The logic circuit 13 may be arranged to activate the lights 17 in a preprogrammed sequence, or all simultaneously, as befits the situation. The lights 17 are preferably mounted on a board 18, as shown in FIG. 2, and may be mounted behind one or more coloured or textured filters 19 to produce a desired colour or effect in the display.

The logic circuit 13 may be arranged to activate both visual display circuit 12 and the audio circuit 11 simultaneously, and alternatively might activate one before or after the other. It might, for example, be found preferable in some situations to activate the audio circuit first, using a sound broadcast to attract a person's attention to a general area, and then to activate the visual display circuit after a short delay, to attract said person's attention to a particular point.

The visual display circuit 12 might include elements other than lights, such as LCD screens and/or mechanical signalling devices, but at present these appear less preferable than the use of lights for reasons such as expense, power consumption and susceptibility to vandalism.

The passive visual display of the preferred apparatus comprises a plate 20 bearing sign 21. Preferably the plate 20 is wholly or partly transparent, and the sign 21 is printed on paper or card, to be held in a recess 22 in the back face of the plate 20. Preferably the means by which the sign 21 is held in the recess 22 allows it to be removed and replaced, such that messages bourne by the apparatus may conveniently be changed from time to time. If one or more filters 19 are to be used with the apparatus, these may be used to press the sign 21 into the recess 22 and hold it in place, as shown in FIG. 2.

The sign 21 preferably carries a message which a potential customer is intended to read or see, preferably relating to goods on an adjacent shelf. This might in normal use include the name of a particular product, and information relating to it such as a special price or notable feature.

In the preferred form of the invention, the plate 20 comprises the front of the casing of the article. The apertures 16, through which the sensors 15 are directed and through which sound from the audio circuit 11 emanates, are formed in this plate 20. Frosted or textured areas might also be formed in the plate 20 to act as screens or filters for the lights 17.

A passive visual display might not be required, particularly if the audio circuit 11 can produce a spoken message, or the visual display circuit 12 can produce a written message with arrangements of lights 17, LCD screens or similar. However, a passive visual display appears preferable at present, in that it provides a permanent display, even when the apparatus has not been activated, and also because it can be relatively inexpensive and does not require power.

The casing of the preferred apparatus comprises a cabinet 23, with the plate 20 forming a front face. The rear 24 of the cabinet has a horizontal indented channel 25 therein by which the cabinet may be fixed onto a shelf. In normal use a shelf is slotted into the channel 25, and the cabinet may then be clamped onto the shelf to fix it firmly in place. Clamping means may include a fixing bracket 26 having screws 27 by which it can be substantially immovably fixed to the shelf, and bolts 28 and nuts 29 by which the cabinet 23 can in turn be fixed to the bracket 26. Apertures are provided through the rear of the cabinet in the horizontal channel 25, through which the bolts 28 from inside the cabinet 23 fix the cabinet to the bracket. When the cabinet is fixed to the bracket in this manner, the screws 27 cannot readily be accessed, and consequently the bracket cannot readily be removed from the shelf to which it binds the cabinet.

The plate 20 is fixed to the body of the cabinet 23 by spring clips 30, which engage with catches 31 on the inside surface of the sides or rear of the cabinet 23. Preferably apertures 32 in the cabinet 23 are associated with the catches 31, by which an appropriate key can be inserted from the exterior to disengage the clips 30 from the catches 31, and thereby release the plate 20 to allow access to the cabinet interior.

The power supply 14 for the apparatus preferably comprises batteries, contained within the cabinet 23, rather than an external power source. In a store such as a supermarket it is generally preferable to avoid having electrical cables crossing the shop floor where possible, as these can be unsightly and possibly hazardous. The power supply 14 may include one or more transformers for voltage conversion to suit the particular electrical elements involved.

The logic circuit 13, used to activate and control the audio circuit 11 and visual display circuit 12, is preferably programmable such that the display may be altered from time to time and to suit different applications. The logic circuit 13 might be relatively complex so as to allow variations in the display, or to make use of multiple sensors and a range of possible outputs to be activated. Alternatively it could be relatively simple, activating the same circuits each time in response to signals from the sensing apparatus 10.

A variety of modifications and alterations might be made to the above example within the scope of the present invention.

The example given relates to a relatively small article intended to be fixed to a shelf, but it will be appreciated that a freestanding, possibly larger model might be produced, and in such a case it may be convenient for a number of modifications to be made. The sensors 15 might be directed to cover an arc of possibly 180° or 360°, rather than being forward-facing only. If the power consumption of the apparatus is great, it may be more practical to use an external power source rather than batteries. A freestanding article will not require the means for attachment to a shelf, but might require alternative fixing means to prevent its being shifted from place to place.

Other alterations might also be made within the general spirit and scope of the present invention as set forth in the following claims.

We claim:

1. An advertising apparatus comprising:

(a) a casing;

(b) a power source arranged in said casing;

(c) passive infra-red detection means arranged within said casing and connected with said power source for detecting the presence of at least one person in an area of detection comprising a substantially triangular field having an apex at said detection means, and an angle of at least 5 degrees at said apex;

(d) display means connected with said casing and said power source, said display means being directed toward said area of detection; and, (e) control means arranged in said casing and connected with said display means for activating and controlling said display means in response to operation of said detection means, whereby said display means is operable to display a message to an individual when the individual enters said area of detection.

2. An advertising apparatus according to claim 1, wherein said triangular field has an apex of between 5 degrees and 30 degrees at said apex.

3. An advertising apparatus according to claim 1, further including mounting means for mounting said casing on a support, said mounting means being operable for mounting and dismounting said casing only from within said casing, said casing comprising a wall which can be removed from said casing to provide access to said mounting means, said wall being mountable on said casing by means of spring clips which cooperate with catches inside said casing to lock said wall on said casing, said casing being provided with apertures through which apertures a releasing device can be inserted to release said spring clips from said catches.

* * * * *